US005549053A

United States Patent [19]

Grout

[11] Patent Number: 5,549,053

[45] **Date of Patent: * Aug. 27, 1996**

[54] DESK FRAME

[75] Inventor: John E. Grout, New South Wales, Australia

[73] Assignee: Ergonomix Armdec Pty. Ltd., Padstow, Australia

[ * ] Notice: The term of this patent shall not extend beyond the expiration date of Pat. No. 5,337,678.

[21] Appl. No.: 367,591

[22] Filed: Jan. 3, 1995

[30] Foreign Application Priority Data

Jan. 4, 1994 [AU] Australia ..... PM3230

[51] Int. Cl.[6] ..... A47B 9/00

[52] U.S. Cl. ..... 108/147; 108/144

[58] Field of Search ..... 108/147, 144; 248/188.1, 188.4, 188.2, 404, 405, 157

[56] References Cited

U.S. PATENT DOCUMENTS

| | | | |
|---|---|---|---|
| 668,627 | 2/1901 | Crow | 108/147 X |
| 906,538 | 12/1908 | Limoges | 108/147 X |
| 2,368,748 | 2/1945 | Doty | 108/147 |
| 3,908,565 | 9/1975 | Burnett | 108/147 |
| 4,590,856 | 5/1986 | Rutsche et al. | 108/147 X |
| 4,604,955 | 8/1986 | Fleischer et al. | 108/147 |
| 4,615,279 | 10/1986 | de la Haye | 108/147 X |
| 4,850,563 | 7/1989 | Grout | 108/147 X |
| 4,981,085 | 1/1991 | Watt | 108/147 |
| 5,337,678 | 8/1994 | Grout | 108/147 |
| 5,367,963 | 11/1994 | Jaggi et al. | 108/147 |

*Primary Examiner*—Jose V. Chen
*Attorney, Agent, or Firm*—Ladas & Parry

[57] ABSTRACT

A height adjustable desk including a work bench which is height adjustable and supported upon a pair of upwardly extending legs. The leg includes an upper portion supported on a lower portion. A height adjustment mechanism is manipulated by the user to adjust the height of the upper portion. This motion is transferred to the upper portion of the leg by means of cooperating rack gears meshingly engaged with their associated pinion gears. A shaft couples the gears so that the upper portions move in unison. The height adjustment mechanism includes a cooperating worm gear and nut. The worm gear is supported by the upper portion, while the nut is mounted in the lower portion.

15 Claims, 5 Drawing Sheets

DESK FRAME

TECHNICAL FIELD

The present invention relates to desk frames and more particularly to adjustable desk frames which have a top surface which is height adjustable.

BACKGROUND OF THE INVENTION

The present invention relates to improvements in adjustable desk frames such as those disclosed in U.S. Pat. No. 4,850,563.

Desk frames have usually included a top work bench which is supported on two legs which are height adjustable. One of the legs is provided with a handle connected to the operating mechanism which adjusts the height of the legs and therefore the top work bench. The legs are not interchangeable and therefore desks which are left or right handed (in respect of operating mechanism) must be separately manufactured. This greatly increases the cost of manufacture and storage.

OBJECT OF THE INVENTION

It is the object of the present invention to overcome or substantially ameliorate the above disadvantages.

SUMMARY OF THE INVENTION

There is disclosed herein a height adjustment mechanism for a height adjustable desk having a pair of spaced legs to support a work bench, each leg including an upper portion to be fixed to the bench, and a lower portion to engage a surface supporting the desk, said mechanism comprising:

a drive shaft having an extremity to be manipulated by a user to case rotation of the shaft about its longitudinal axis;

means to rotatably support said shaft horizontally in said upper portion for rotation about its longitudinal axis;

a worm gear connected to said shaft so that said worm gear will rotate therewith about the longitudinal axis of the worm gear;

means to mount said worm gear in said upper portion so that said worm gear is generally vertically extending and is rotatable about its longitudinal axis; and a nut to be mounted on said lower portion and threadably engaged with said worm gear so that rotation of said worm gear causes movement of said nut along said worm gear so that in use said rotation causes vertical movement of said upper portion with respect to said lower portion.

There is further disclosed herein a height adjustable desk having a frame, a work bench mounted on the frame, and a height adjustment mechanism to vertically adjust the height of the work bench;

said frame comprising a pair of parallel upwardly extending legs which are horizontally spaced and generally coextensive, each leg including an upper portion to be fixed to the bench, and a lower portion to engage a surface supporting the desk; and wherein said height adjustment mechanism includes a drive shaft having an extremity to be manipulated by a user to cause rotation of the shaft about its longitudinal axis, means rotatably supporting said shaft horizontally in the upper portion of one of said legs for rotation about its longitudinal axis, a worm gear connected to said shaft so that said worm gear will rotate therewith about the longitudinal axis of said worm gear, means mounting said worm gear in the upper portion of said one leg so that said worm gear is generally vertically extending and is rotatable about its longitudinal axis, a nut mounted in the lower part of said one leg and threadably engaged with said worm gear so that rotation of said worm gear causes movement of said nut along said worm gear thereby vertically moving said upper portion of said one leg with respect to the lower portion of said one leg, and movement transfer means to cause a corresponding movement of the upper part of the other leg in unison with the upper part of said one leg.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
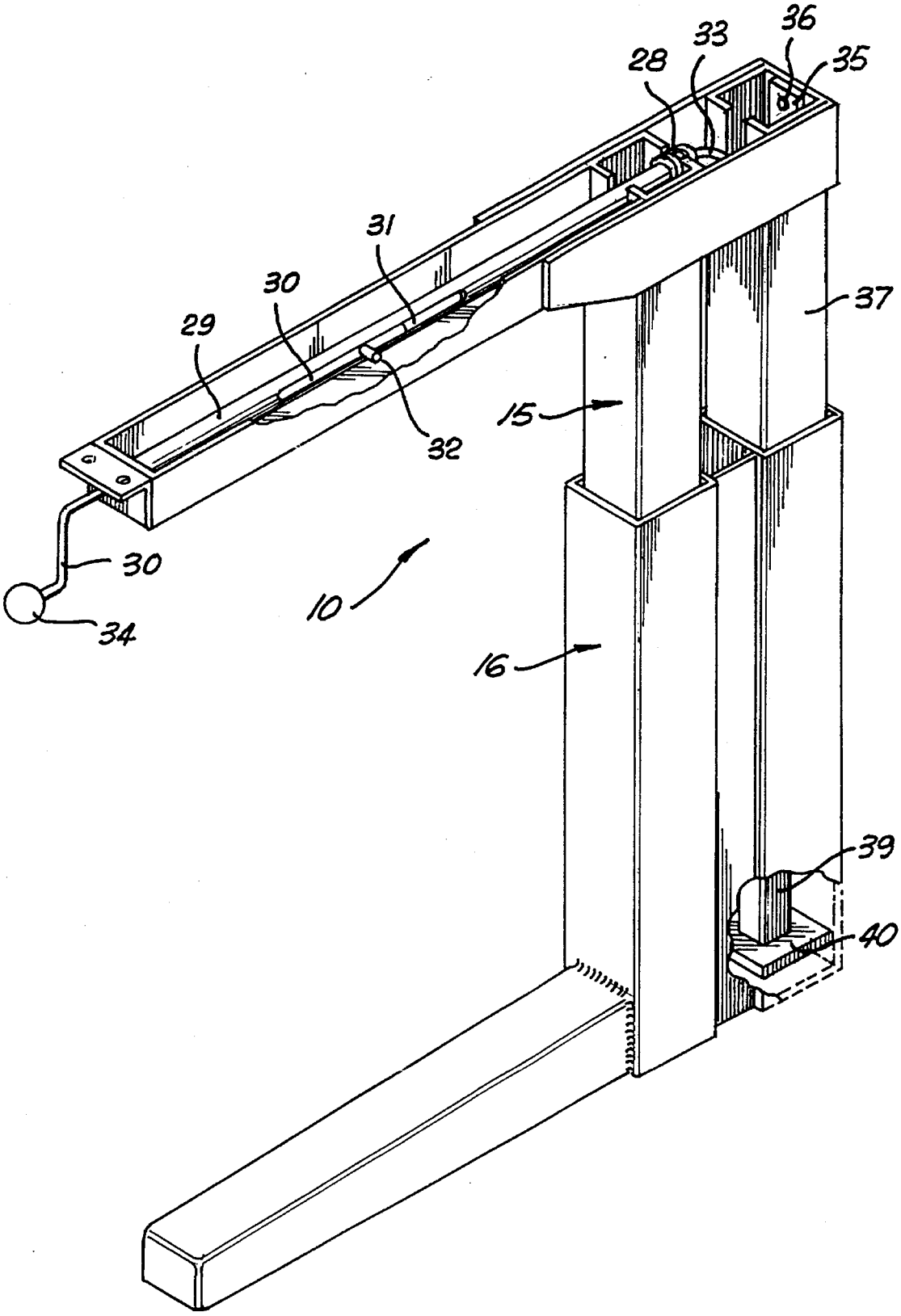
FIG. 1 is a schematic perspective view of a leg for a height adjustable desk.
Figure 2:
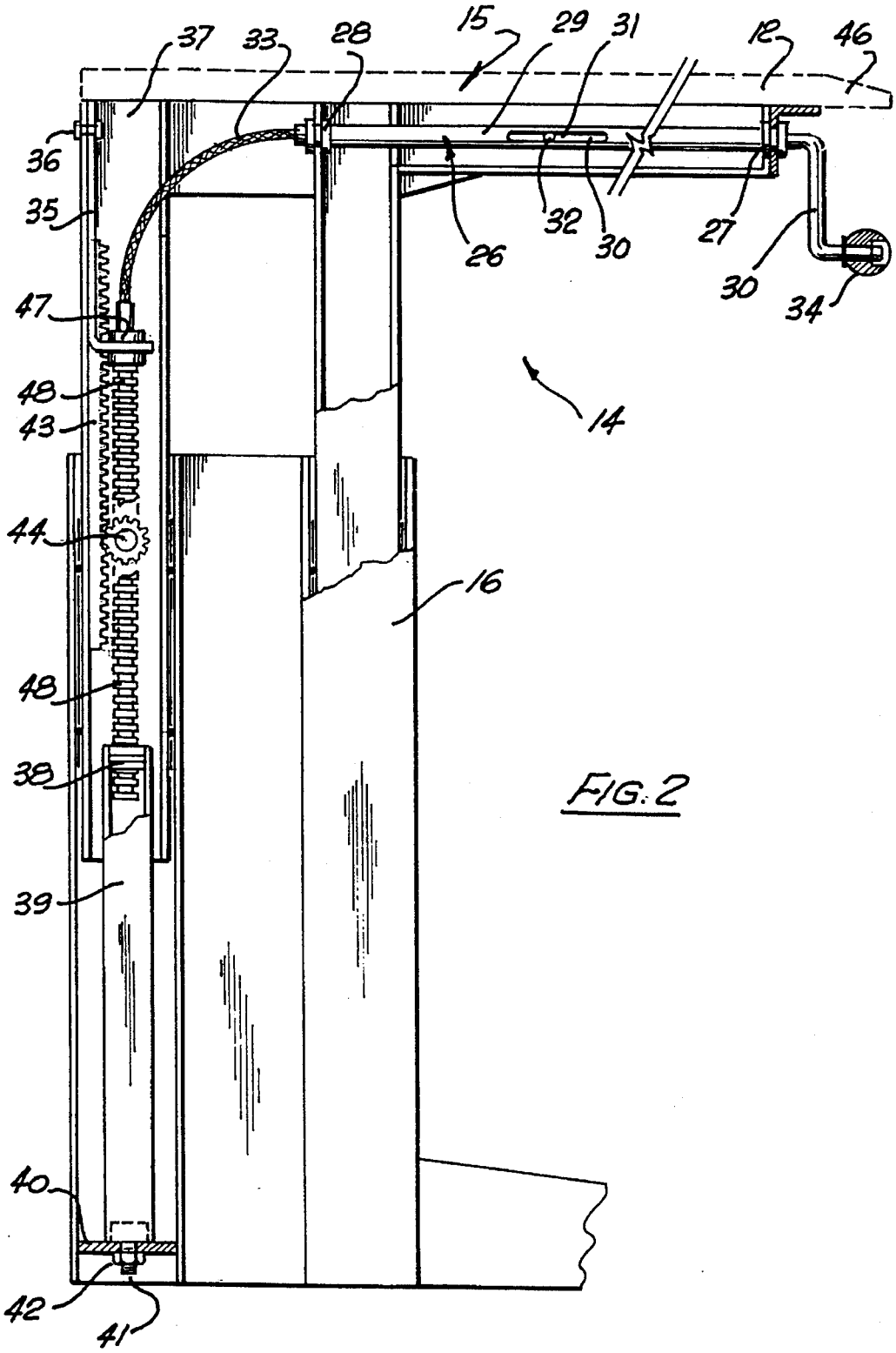
FIG. 2 is a schematic sectioned side elevation of the desk leg of FIG. 1.
Figure 3:
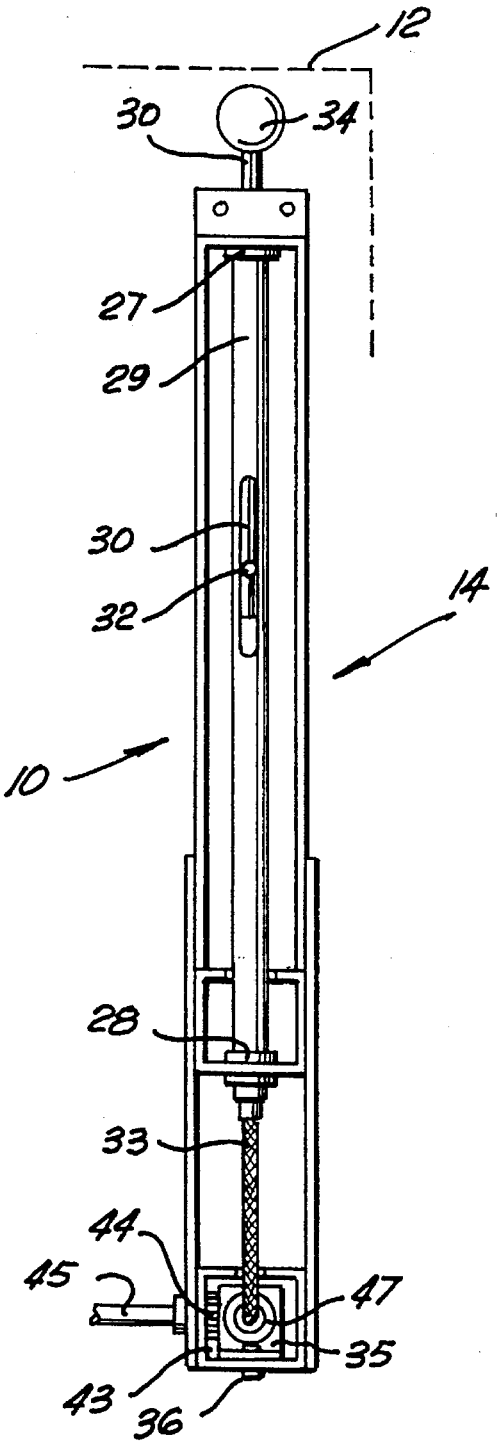
FIG. 3 is a schematic top plan view of the desk leg of FIG. 1.
Figure 4:
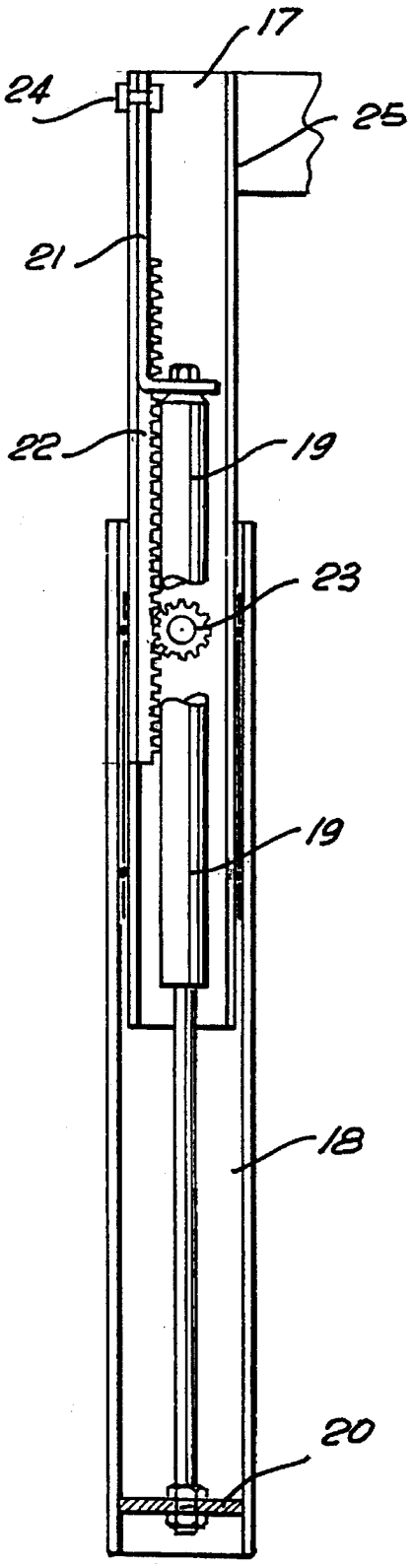
FIG. 4 is a schematic side elevation of a further desk leg.
Figure 5:
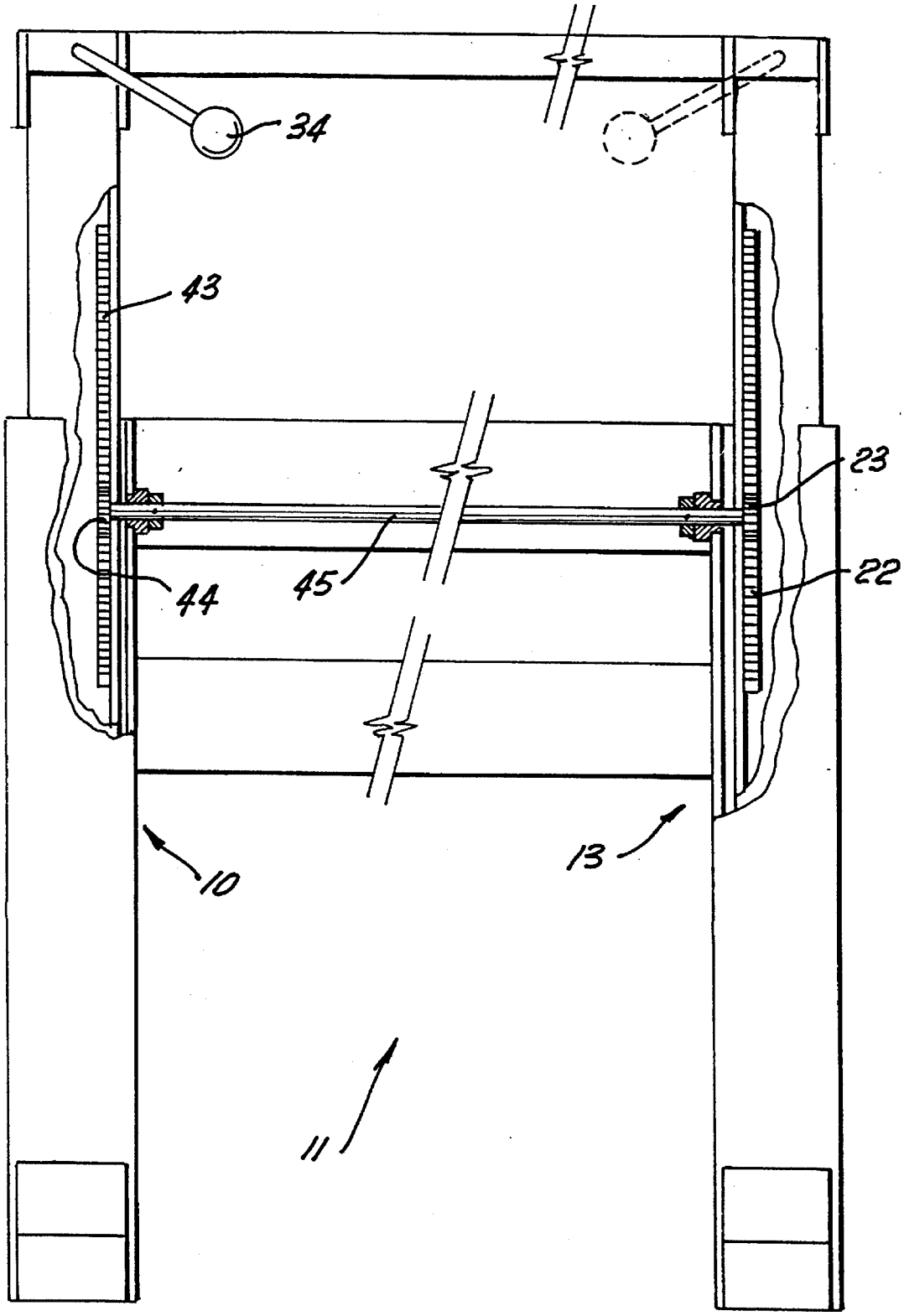
FIG. 5 is a schematic front elevation of a desk frame employing a pair of desk legs, of which one of the legs is the desk leg of FIG. 1.
Figure 6:
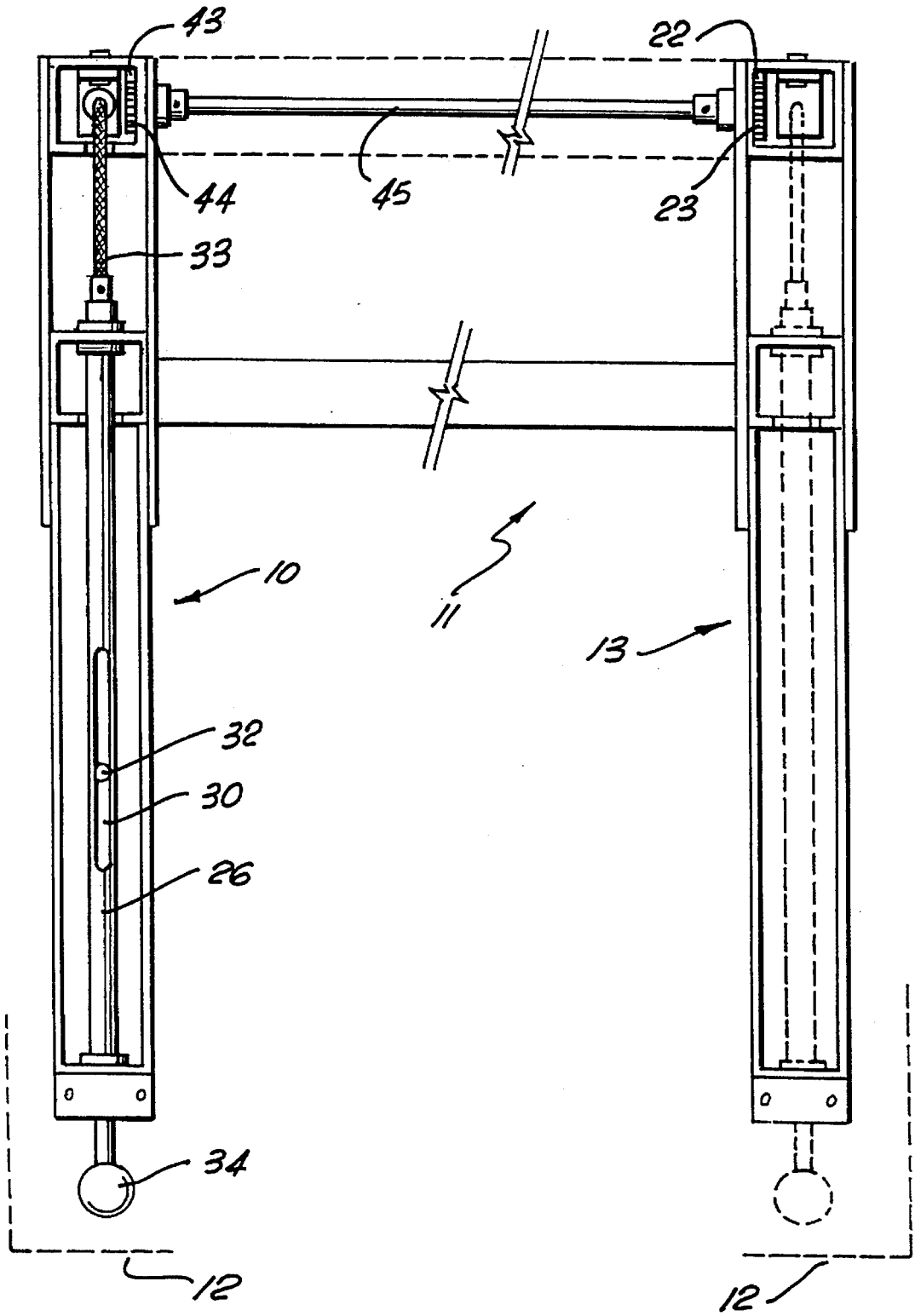
FIG. 6 is a schematic top plan view of the desk frame of FIG. 5.

In the accompanying drawings there is schematically depicted a height adjustable desk frame 11 to support a work bench 12 so that the work bench 12 is height adjustable with respect to the supporting floor. The frame 11 includes legs 10 and 13. The legs 10 and 13 are not interchangeable. In the leg 10, the operating mechanism 14 is manipulated by the user to adjust the height of the upper portion 15 of the leg 10, with respect to the lower portion 16. Motion is transferred to the leg 13 so that the upper portion 17 of the leg 13 is moved relative to the lower portion 18. In the leg 13, a gas strut 19 extends between a plate 20 fixed to the lower portion 18 and an L-shaped bracket 21 fixed to the upper portion 17 to aid in raising the desk and to control lowering of the desk. Fixed to the upper part 17 is a rack gear 22 meshingly engaged with a pinion gear 23, with the pinion gear 23 fixed to the lower portion 18. The rack gear 22 and pinion 23 aid in motion transfer between the legs 10 and 13. An assembly of the bracket 21 and gas strut 19 may be removed from within the leg 13 by removal of the threaded fastener 24. The bracket 21 is particularly shaped so as to be received within the hollow tube 25 of the leg 13.

Removably incorporated in the leg 10 is the operating mechanism 14 so that the operating mechanism 14 may be removed as an entire assembly and interchanged with the assembly incorporating the gas strut 19. By this arrangement, the desk can be made right or left handed in respect of height adjustment operation.

The mechanism 14 includes a shaft 26 which is supported by means of a bush 27 fixed to the upper part 15. A bearing or further bush 28 is captively located with respect to the shaft 26 but is received within a shaped recess in the upper part 15. The shaft 26 includes a telescopically associated tube 29 which receives a rod 30. The tube 29 has a slot 31 through which a pin 32 projects to engage the rod 30. In operation, the handle 34 may be moved outward beyond the edge 46 of the desk to enable operation. This is permitted by means of sliding movement of the pin 32 along the slot 31. One extremity of the shaft 26 engages a flexible drive 33 extending to and driving a worm gear 48. The worm gear 48 is rotatably mounted in an L-shaped bracket 35 by means of a bearing 47. The bearing 47 is captively located with respect to the bracket 35. The bracket 35 is held in position by means of a threaded fastener 36, with the bracket 35 being adapted to engage within the tube 37 of the upper portion 15.

The lower end of the worm gear 48 is engaged with a nut 38 supported by a pedestal 39 extending to the bottom plate 40. The pedestal 39 has a threaded pin 41 engaged by a nut 42. The pin 41 projects through an aperture in the plate 40 while the nut 42 holds the pedestal in position.

By rotation of the worm gear 48 about its longitudinal axis, engagement with the nut 38 will raise and lower the upper portion 15 with respect to the lower portion 16. This is accomplished merely by rotation of the handle 34 about the longitudinal axis of the shaft 26.

Fixed to the upper part 15 is a rack gear 43 which is meshingly engaged with a pinion gear 44, fixed with respect to the lower portion 16. A shaft 45 extends between the pinion gears 23 and 44 in order to transfer motion between the legs 10 and 13. As the upper portion 15 is caused to move vertically, it takes with it the rack gear 43 causing rotation of the pinion gear 44. The pinion gear 44 rotates the shaft 45 which in turn rotates the pinion gear 23 causing the upper portion 17 to move vertically due to the meshing engagement of the pinion gear 23 with the rack gear 22.

The operating mechanism 14, which incorporates the threaded rod 41, pedestal 39, nut 38, worm gear 48, bracket 35, bearing 47, flexible drive 33, bearing 28 and shaft 26, may be removed as a unit and interchanged with the assembly incorporating the gas strut 19.

To remove the operating mechanism 14, the pin 32 is removed which enables withdrawal of the rod 30 by pulling it through the bushing 27. Thereafter, the tube 29 may be raised taking with it the bearing 28. The threaded fastener 36 is removed as is the nut 42. The bracket 35 is then raised taking with it the worm gear 48, nut 38 and pedestal 39 together with the bearing 47.

What I claim is:

1. A height adjustment mechanism for a height adjustable desk having a pair of spaced legs to support a work bench, each leg including an upper portion to be fixed to the bench, and a lower portion to engage a surface supporting the desk, said mechanism comprising:

a drive shaft having an extremity to be manipulated by a user to cause rotation of the shaft about its longitudinal axis;

means to rotatably support said shaft generally horizontally in said upper portion for rotation about its longitudinal axis;

a worm gear connected to said shaft so that said worm gear will rotate therewith about the longitudinal axis of the worm gear;

means to mount said worm gear in said upper portion so that said worm gear is generally vertically extending and is rotatable about its longitudinal axis;

a nut to be mounted on said lower portion and threadably engaged with said worm gear so that rotation of said worm gear causes movement of said nut along said worm gear so that in use said rotation causes vertical movement of said upper portion with respect to said lower portion;

a pedestal having said nut fixed to an upper end thereof, with said pedestal having a lower end to engage a respective one of the lower portions; and a mounting bracket rotatable supporting an upper end of said worm gear, said bracket being fixed to a respective one of the upper portions.

2. The mechanism of claim 1, wherein said worm gear is connected to said shaft by a flexible drive.

3. The mechanism of claim 2, wherein said nut is mounted on a pedestal, so that upon installation in said lower part, said nut is spaced from said surface.

4. The mechanism of claim 3, further including a mounting bracket to be fixed to said upper part, and a bearing rotatably supporting said worm gear in said bracket.

5. The mechanism of claim 1, wherein said nut is mounted on a pedestal, so that upon installation in said lower part, said nut is spaced from said surface.

6. The mechanism of claim 5, further including a mounting bracket to be fixed to said upper part, and a bearing rotatably supporting said worm gear in said bracket.

7. A height adjustable desk having a frame, a work bench mounted on the frame, and a height adjustment mechanism to vertically adjust the height of the work bench;

said frame comprising a pair of parallel upwardly extending legs which are horizontally spaced and generally co-extensive, each leg including an upper portion to be fixed to the bench, and a lower portion to engage a surface supporting the desk; and wherein said height adjustment mechanism includes a drive shaft having an extremity to be manipulated by a user to cause rotation of the shaft about its longitudinal axis, means rotatably supporting said shaft generally horizontally in the upper portion of one of said legs for rotation about its longitudinal axis, a worm gear connected to said shaft so that said worm gear will rotate therewith about the longitudinal axis of said worm gear, means mounting said worm gear in the upper portion of said one leg so that said worm gear is generally vertically extending and is rotatable about its longitudinal axis, a nut mounted in the lower part of said one leg and threadably engaged with said worm gear so that rotation of said worm gear causes movement of said nut along said worm gear thereby vertically moving said upper portion of said one leg with respect to the lower portion of said one leg, a pedestal having said nut fixed to an upper end thereof, with said pedestal having a lower end fixed to said lower portion of said one leg, a mounting bracket notably supporting an upper end of said worm gear, said bracket being fixed to the upper portion of said one leg, and movement transfer means to cause a corresponding movement of the upper part of the other leg in unison with the upper part of said one leg.

8. The desk of claim 7, wherein said movement transfer means includes a first rack fixed to the upper part of said one leg, a first gear meshingly engaged with said first rack, said first gear being mounted on the lower part of said first leg, a second rack, said second rack being fixed to the upper part of said second leg, a second gear, said second gear being mounted on the lower part of said second leg and meshingly engaged with said second rack, a shaft fixed to said first gear and said second gear so that they rotate in unison to thereby cause movement of the upper part of said second leg in unison with the upper part of said first leg.

9. The desk of claim 7, wherein each upper part has a portion which is telescopically received within a portion of the associated lower part.

10. The desk of claim 7, further including a transverse brace extending between the two legs, and wherein the shaft extending between said first and second gears is located adjacent said transverse brace.

11. The mechanism of claim 7, wherein said worm gear is connected to said shaft by a flexible drive.

12. The mechanism of claim 11, wherein said nut is mounted on a pedestal, so that upon installation in said lower part, said nut is spaced from said surface.

13. The mechanism of claim 12, further including a mounting bracket to be fixed to said upper part, and a bearing rotatably supporting said worm gear in said bracket.

14. The mechanism of claim 7, wherein said nut is mounted on a pedestal, so that upon installation in said lower part, said nut is spaced from said surface.

15. The mechanism of claim 14, further including a mounting bracket to be fixed to said upper part, and a bearing rotatably supporting said worm gear in said bracket.

* * * * *